US005096803A

United States Patent [19]

Kanetake et al.

[11] Patent Number: 5,096,803

[45] Date of Patent: Mar. 17, 1992

[54] METHOD FOR THE MANUFACTURE OF SILVER HALIDE PHOTOGRAPHIC MATERIALS

[75] Inventors: Satoshi Kanetake; Shinichi Hashimoto, both of Kanagawa, Japan

[73] Assignee: Fuji Photo Film Co., Ltd., Kanagawa, Japan

[21] Appl. No.: 510,774

[22] Filed: Apr. 18, 1990

[30] Foreign Application Priority Data

Apr. 20, 1989 [JP] Japan ..... 1-101118

[51] Int. Cl.[5] ..... G03C 5/00

[52] U.S. Cl. ..... 430/349; 430/533; 430/535; 430/935; 430/939; 427/377; 427/393.5

[58] Field of Search ..... 430/533, 935, 939, 349, 430/535; 427/377, 393.5

[56] References Cited

U.S. PATENT DOCUMENTS

| | | | |
|---|---|---|---|
| 3,936,306 | 2/1976 | Minoda et al. | 430/939 |
| 4,213,783 | 7/1980 | Cook | 430/533 |
| 4,645,731 | 2/1987 | Bayless et al. | 430/533 |
| 4,699,869 | 10/1987 | Bayless et al. | 430/535 |
| 4,933,267 | 6/1990 | Ishigaki et al. | 430/533 |
| 4,946,769 | 8/1990 | Arai et al. | 430/935 |
| 4,977,071 | 12/1990 | Kanetake et al. | 430/533 |

FOREIGN PATENT DOCUMENTS

| | | | |
|---|---|---|---|
| 0279450 | 8/1988 | European Pat. Off. | 430/533 |
| 0056817 | 5/1979 | Japan | 430/935 |

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A method for producing a silver halide photographic material which comprises the steps of:

(a) coating hydrophilic colloid coating liquid on a polyester support;

(b) forming a hydrophilic colloid layer by drying said hydrophilic coating liquid, when A is not more than 300, in an atmosphere having a relative humidity of not more than 50% and such that the ratio A/B is at least 18 wherein

A is determined by the following formula:

$$A=(M/S)\times 100$$

wherein M represents the moisture content by weight of said hydrophilic colloid layer on said support and S represents the solid weight of said hydrophilic colloid layer on said support, and B is the drying time until A is not more than 8 expressed in seconds; and (c) heat treating said coated supported from step (b) at a temperature of at least 30° C. in a atmosphere having an absolute humidity of not more than 1%.

The method of the present invention provides silver halide photographic materials which have improved dimensional stability.

11 Claims, No Drawings

METHOD FOR THE MANUFACTURE OF SILVER HALIDE PHOTOGRAPHIC MATERIALS

FIELD OF THE INVENTION

This invention concerns a method for the manufacture of silver halide photographic materials, especially silver halide photographic materials which have improved dimensional stability.

BACKGROUND OF THE INVENTION

In general terms, silver halide photographic materials have photographic layers in which a hydrophilic colloid is used as a binder, and so they have a disadvantage in that changes in dimensions occur as a result of the expansion and contraction of the photographic layer due to changes in temperature and humidity, and as a result of development processing.

These changes in the dimensions of silver halide photographic materials are a very serious disadvantage for materials used for multicolor printing which involve the reproduction of screen dot images and precise line drawings.

Various methods are known for improving the dimensional stability of silver halide photographic materials.

For example, a technique in which the ratio of the thickness of the hydrophilic colloid layer and the support is defined has been disclosed in U.S. Pat. No. 3,201,250, and methods in which polymer latexes are added to the hydrophilic colloid photographic layer have been disclosed in JP-B-39-4272, JP-B-39-17702, JP-B-43-13482, JP-B-45-5331, and U.S. Pat. Nos. 237,600, 2,763,625, 2,772,166, 2,852,386, 2,853,457, 3,397,988, 3,411,911 and 3,411,912. (The term "JP-B" as used herein means an "examined Japanese patent publication".)

The change in dimension accompanying development processing are caused by the development processing, and since the dimensions at the time of exposure and after development are different they are of great importance from the point of view of the use of silver halide photographic materials. The above mentioned techniques, however fall short of completely overcoming the problem. Thus, it is still necessary to reduce the change in dimension of silver halide photographic materials arising from changes in temperature and humidity.

A technique in which a vinylidene chloride subbing layer is used for improving dimensional stability with respect to development processing has been disclosed in JP-A-64-538. (The term "JP-A" as used herein means an "unexamined published Japanese patent application".) However, it is not possible to improve the dimensional stability in respect of development processing satisfactorily even with this technique, and further improvement is still required.

SUMMARY OF THE INVENTION

The aim of this present invention is to provide silver halide photographic materials which have improved dimensional stability with respect to development processing.

As a result of thorough research, the inventors have discovered that a surprising improvement in dimensional stability with respect to development processing that is completely different from that obtained using known methods can be realized using the method of the present invention.

The aim of the invention is realized by means of a method for producing a silver halide photographic material which comprises the steps of:

(a) coating hydrophilic colloid coating liquid on a polyester support;

(b) forming a hydrophilic colloid layer by drying said hydrophilic coating liquid, when A is not more than 300, in an atmosphnere having a relative humidity of not more than 50% and such that the ratio A/B is at least 18 wherein

A is determined by the following formula:

$$A=(M/S)\times 100$$

wherein M represents the moisture content by weight of said hydrophilic colloid layer on said support and S represents the solid weight of said hydrophilic colloid layer on said support, and B is the drying time until A is not more than 8 expressed in seconds; and (c) heat treating said coated support from step (b) at a temperature of at least 30° C. in an atmosphere having an absolute humidity of not more than 1%.

DETAILED DESCRIPTION OF THE INVENTION

In general, hydrophilic colloid layers are coated onto a support as aqueous coating liquids and dried during the manufacture of silver halide photographic materials. These coating liquids normally contain hydrophilic colloid binders, silver halide grains, surfactants, water soluble additives (such as gelatin film hardening agents), aqueous dispersion type additives (such as polymer latexes and matting agents), and other photographically useful additives.

In the present invention it is necessary when drying the hydrophilic colloid layer coating liquids to carry out the drying in such a way that if a hundredfold of the proportion of the amount of moisture by weight with respect to the solid weight is A (hereinafter, A represents a hundredfold of the proportion of the moisture content by weight with respect to the solid weight) and the drying time until A is not more than 8 is B (seconds) (hereinafter, B represents the drying time until A is not more than 8), A/B is not more than 18, and that when A is not more than 300 the drying must be carried out under conditions of relative humidity not more than 50(%).

In cases where two or more hydrophilic colloid layers are coated and dried simultaneously, the sum of the moisture contents of all the layers is taken for the moisture content, and the solid weight is taken to be the sum of the solid weights in all the layers.

The solid weight as used herein refers to an absolute dry weight per unit area after the coating liquid is introduced into a hot stove at 105° C. for 24 hours and then the moisture content is determined by subtracting the solid weight from the coating weight of the coating liquid per unit area.

The drying time until A is not more than 8, which is represented as B, can be determined by measuring the surface temperature of the coating liquid and the temperature difference at the intake vent and exhaust vent of warm air used at the drying.

The relative humidity referred to in the present invention is the ratio, expressed as a percentage, of the amount of water vapor contained in a fixed volume and the amount of water vapor in this air at saturation.

A/B has a value of at least 18, and preferably has a value of from 20 to 40.

No temperature limitation is imposed on that part of the total drying process for which A/B has a value of at least 18 and A is greater than 300, but the drying temperature is preferably from 30° to 50° C. Furthermore, the relative humidity during the process in which A is not more than 300 is being dried out is not more than 50(%), and preferably from 35 to 50(%).

The heat treatment of this present invention must be carried out at a temperature of at least 30° C., and it is preferably carried out at a temperature of at least 35° C. but not more than 50° C. The heat treatment time depends on the temperature and cannot be generalized but, at a temperature of 45° C., a heat treatment of duration at least about 6 hours is preferred.

The heat treatment in the present invention can be carried out at any time after the coating and drying of the silver halide photographic material.

The manufacture of silver halide photographic materials generally involves winding the material into a temporary roll after coating and drying and then cutting the material to the prescribed size and packaging the material. Hence, the heat treatment of the present invention can be carried out while the material has been wound into a roll, during the cutting operation or during packaging, provided that the silver halide photographic material is being maintained under conditions of absolute humidity of not more than 1%.

The humidity during heat treatment must be an absolute humidity of not more than 1%, and preferably of not more than 0.8%. The absolute humidity of the air is defined by the ratio of the weight of water vapor in the air and the weight of the air. Thus, for example, an absolute humidity of 1% corresponds to a relative humidity of about 50% at 25° C. and a relative humidity of about 21% at 40° C.

The silver halide photographic materials are preferably stored under an atmosphere of an absolute humidity of not more than 1% after coating and drying in order to retain the dimensional stability improving effect of the present invention.

The bulk form of photographic material is most desirably covered with a plastic film and stored during the interval after the completion of drying and prior to heat treatment, and storage of the bulk photographic material under conditions where the humidity is as low as possible such as the relative humidity of 55% or less is preferred.

Here, the term "storage" signifies that the photographic material is kept under conditions consistant with the present invention until it is used by the general user.

The polyester of the present invention is polyester in which aromatic dibasic acids and glycols form the principal structural components. Typical dibasic acids include terephthalic acid, isophthalic acid, p-β-oxyethoxybenzoic acid, diphenylsulfone dicarboxylic acid, diphenoxyethane dicarboxylic acid, adipic acid, sebacic acid, azelaic acid, 5-sodium sulfoisophthalic acid, diphenylene dicarboxylic acid, and 2,6-naphthalene dicarboxylic acid. Typical glycols include ethylene glycol, propylene glycol, butanediol, neopentylene glycol, 1,4-cyclohexanediol, 1,4-cyclohexanedimethanol, 1,4-bisoxyethoxybenzene, bisphenol A, diethyleneglycol, and polyethyleneglycol.

The most desirable polyester for the present invention is poly(ethylene terephthalate) because it can be procured easily.

No particular limitation is imposed upon the thickness of the polyester, but a thickness of from about 12 μm to about 500 μm, and preferably of from about 40 μm to about 200 μm, is useful because it is available and easily handled. Biaxially extended crystallized polyester supports are preferred because of their stability and strength.

The polyester supports of the present invention may be coated with a subbing layer which contains, for example, gelatin, styrene/butadiene copolymer, vinylidene chloride, aqueous polyester, aqueous polyurethane before coating the hydrophilic colloid layer. The use of subbing layers which contain vinylidene chloride is especially desirable, and this completes the remarkable dimensional stability improving effect in conjunction with the present invention. Furthermore, in the present invention the surface of the polyester support may be subjected to a surface treatment, such as a coronal treatment or a glow discharge treatment, prior to the coating of the subbing layer.

Moreover, the present invention may be used conjointly with other methods for producing silver halide material, for example, those disclosed in JP-A-56-82504, JP-A-56-143431, JP-A-57-104931, JP-A-58-62647 and JP-A-58-62649 for anti-static purpose.

In the present invention, a polymer latex is preferably used in the hydrophilic colloid layer for improving the dimensional stability.

Preferred examples of the polymer latexes which can be used in the present invention include polymers which have alkyl esters, hydroxyalkyl esters or glycidyl esters of acrylic acid, or alkyl esters, hydroxyalkyl esters or glycidyl esters of methacrylic acid, as monomer units, and which are of a molecular weight of at least 100,000, and preferably of a molecular weight of from 300,000 to 500,000. Actual examples of these polymers are indicated below.

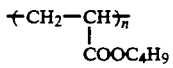
Polymer 1

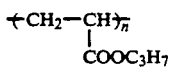
Polymer 2

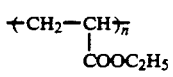
Polymer 3

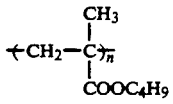
Polymer 4

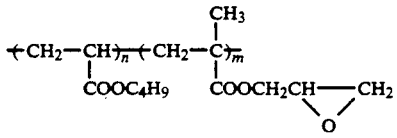
Polymer 5

-continued

Polymer 6

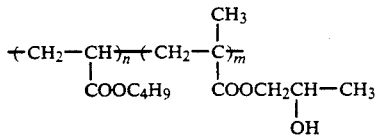

The polymer latexes used in the present invention are aqueous dispersions of water insoluble polymers having an average particle diameter from 20 mμ to 200 mμ. The amount of polymer latex used is preferably from 0.01 to 1.0, and most desirably 0.1 to 0.8, in terms of the dry weight ratio with respect to the gelatin which is used as binder.

Moreover, reference can be made to the disclosures made, for example in the aforementioned JP-B-45-5331, and U.S. Pat. Nos. 2,852,386, 3,062,674, 3,411,911 and 3,411,912 in connection with polymer latexes.

The polymer latexes used in the present invention are included in at least one hydrophilic colloid layer, for example in at least one silver halide emulsion layer, backing layer, protective layer or intermediate layer.

The hydrophilic colloid layers in photographic materials of the present invention are, for example, silver halide emulsion layers, backing layers, protective layers and intermediate layers, and hydrophilic colloids are used in these layers. Gelatin is most desirable as the hydrophilic colloid, and lime treated gelatin, acid treated gelatin, enzyme treated gelatin and gelatin derivatives and modified gelatins, for example, which are used generally in the industry can be used as the gelatin. The use of lime treated gelatins and acid treated gelatins is preferred.

Furthermore, proteins such as colloidal albumin and casein, cellulose derivatives such as carboxymethylcellulose and hydroxyethylcellulose, sugar derivatives such as agar, sodium alginate and starch derivatives, synthetic hydrophilic colloids, for example poly(vinyl alcohol), poly-N-vinylpyrrolidone polyacrylic acid copolymers, polyacrylamide and derivatives and partial hydrolyzates thereof can be used as well as gelatin. Mixtures of two or more of these colloids can be used, as required.

The present invention can be used to particular effect in superhigh contrast light-sensitive materials which contain hydrazine derivatives. These hydrazine containing superhigh contrast light-sensitive materials and methods for the formation of images in which these materials are used have been disclosed, for example, in U.S. Pat. Nos. 4,224,401, 4,168,977, 4,166,742, 4,241,164 and 4,272,606, JP-A-60-83028, JP-A-60-218642, JP-A-60-258537 and JP-A-61-223738.

The use of hydrazine derivatives which can be represented by the general formula (Q) indicated below are preferred as the hydrazine derivatives used in the present invention:

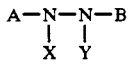

(Q)

wherein A represents an aliphatic group or an aromatic group, B represents a formyl group, an acyl group, an alkyl or aryl sulfonyl group, an alkyl or aryl sulfinyl group, a carbamoyl group, an alkoxy or aryloxy carbonyl group, a sulfinamoyl group, an alkoxysufonyl group, a thioacyl group, a thiocarbamoyl group, a sulfamoyl group or a heterocyclic group, and X and Y both represent hydrogen atoms, or one of them represents a hydrogen atom and the other represents a substituted or unsubstituted alkylsulfonyl group, a substituted or unsubstituted arylsulfonyl group, or a substituted or unsubstituted acyl group.

Typical compounds from among those which can be represented by the general formula (Q) are indicated below.

(Q-1)

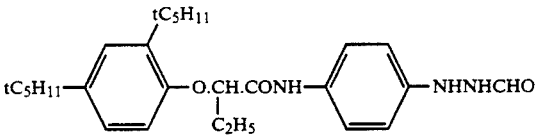

(Q-2)

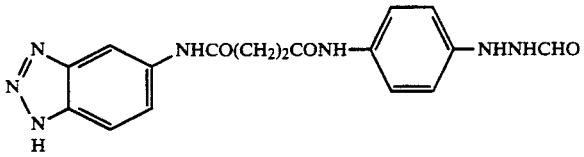

(Q-3)

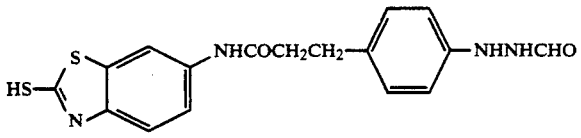

Q-4)

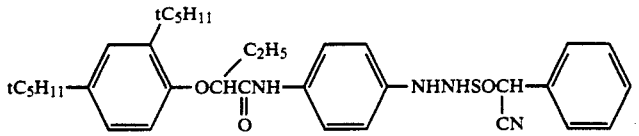

-continued (Q-5)

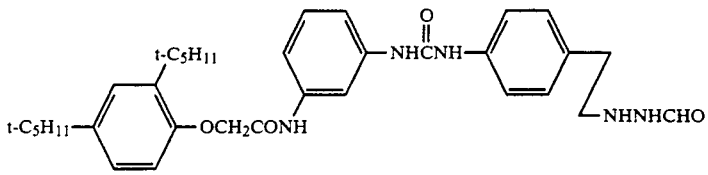

(Q-6)

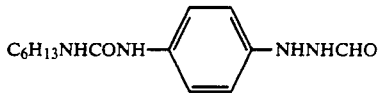

(Q-7)

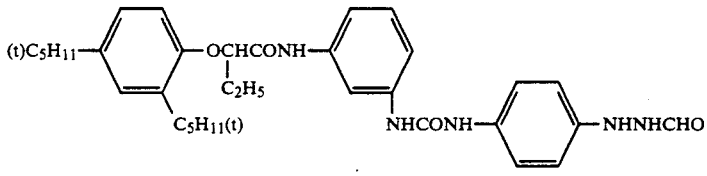

Moreover, the present invention is effective in cases in which light-sensitive materials which contain tetrazolium compounds are subjected to procedures for obtaining high contrast involving the use of PQ type or MQ type developers which contain a comparatively high concentration of sulfite. Methods of image formation using tetrazolium compounds have been disclosed, for example, in JP-A-52-18317, JP-A-53-17719 and JP-A-53-17720.

The silver halide emulsions in the photographic materials used in the present invention are normally prepared by mixing a solution of a water soluble silver salt (for example silver nitrate) and a solution of a water soluble halide (for example potassium bromide) in the presence of a water soluble polymer solution such as a gelatin solution.

Silver chloride, silver bromide, silver chlorobromide, silver iodobromide and silver chloroiodobromide can be used for the silver halide, and no limitation is imposed on the form of the grains or the grain size distribution.

The silver halide emulsion layer can contain photographic silver halide, chemical sensitizers, spectral sensitizers, anti-foggants, hydrophilic colloids (especially gelatin), agents such as gelatin hardening agents and surfactants for improving the physical properties of the film, and thickeners, etc. Reference can be made to the disclosures made in *Research Disclosure,* Vol. 176, Item 17643 (December, 1978), and in JP-A-52-108130, JP-A-52-114328, JP-A-52-121321, JP-A-53-3217 and JP-A-53-44025 in connection with these materials.

The polyalkylene oxides of a molecular weight of at least 600 disclosed in JP-B-58-9412 are the most desirable surfactants for use in the present invention.

The surface protective layer is a layer of thickness from 0.3 to 3 μm, and preferably of thickness from 0.5 to 1.5 μm, comprised of a hydrophilic binder such as gelatin. This layer may contain matting agents such as fine particles of poly(methyl methacrylate), colloidal silica and, as required thickeners such as poly(potassium styrenesulfonate), gelatin hardening agents, surfactants, slip agents and UV absorbers, for example.

The backing layer is a light-insensitive layer comprised of as a binder a hydrophilic colloid such as gelatin. It may have a single layer structure, or a multi-layer structure with intermediate and protective layers.

The thickness of the backing layer is from 0.1 to 10 μm and, like the silver halide emulsion and surface protective layers, it may contain gelatin hardening agents, surfactants, matting agents, colloidal silica, slip agents, UV absorbers, dyes, and thickeners.

The methods of the present invention can be applied to a variety of photographic materials which have hydrophilic colloid layers. Typically it can be used with photographic materials of the type in which silver halide is used as the light-sensitive component, for example, light-sensitive materials for printing purposes, light-sensitive materials for X-ray purposes, general negative light-sensitive materials, general reversal light-sensitive materials, general positive light-sensitive materials and direct positive light-sensitive materials. The effect of the present invention is especially pronounced in the case of light-sensitive materials used for printing purposes.

No limitation is imposed on the methods of exposing and developing the light-sensitive materials of the present invention, and reference can be made to the disclosures made, for example, in JP-A-52-108130, JP-A-52-114328 and JP-A-52-121321, and in the above mentioned *Research Disclosure,* Vol. 176, Item 17643.

Furthermore, the development rate can be increased and the development time can be shortened by adding amines to the developing solution as disclosed, for example, in JP-A-60-258537 and U.S. Pat. No. 4,269,929.

The invention is described in detail below by means of illustrative examples, but the invention is not limited by these examples.

EXAMPLE 1

The silver halide emulsion layer and protective layer 1 indicated below were coated sequentially in order from the support side on one side of a support on which the second subbing Composition 1 had been used from among the undercoated supports described in Example 1 in JP-A-60-26944 (corresponding to U.S. Pat. No. 4,542,093), and this was dried under the conditions shown in Table 1. Next, the backing layer and the protective layer 2 were coated on the opposite side and dried under the conditions shown in Table 1.

(1) Formulation of the Silver Halide Emulsion Layer

An aqueous solution of silver nitrate and a mixed aqueous solution of sodium chloride and potassium bromide were added simultaneously at a constant rate over a period of 30 minutes to an aqueous gelatin solution which was being maintained at 50° C. in the presence of $2\times10^{-5}$ mol per mol of silver of rhodium chloride to prepare a mono-dispersed silver chlorobromide emulsion of average grain size 0.2 μm (Cl content 95 mol %).

This emulsion was de-salted using the flocculation method, 1 mg of thiourea dioxide and 0.6 mg of chloroauric acid were added per mol of silver and the mixture was ripened at 65° C. until the optimum performance was attained and fogging had occurred.

The compounds indicated below were also added to this emulsion.

-continued

| | |
|---|---|
| Sodium dodecylbenzenesulfonate | 50 mg/m$^2$ |
| 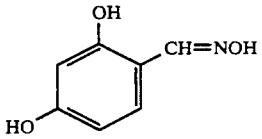 | 20 mg/m$^2$ |
| 5-Nitroindazole | 15 mg/m$^2$ |
| 1,3-Divinylsulfonyl-2-propanol | 50 mg/m$^2$ |
| N-Perfluorooctanesulfonyl-N-propylglycine, potassium salt | 2 mg/m$^2$ |
| Ethyl acrylate latex (average particle size 0.1 μm) | 300 mg/m$^2$ |
| 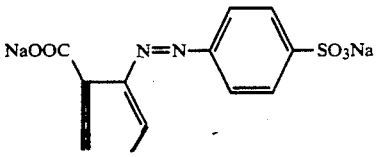 | 100 mg/m$^2$ |
| 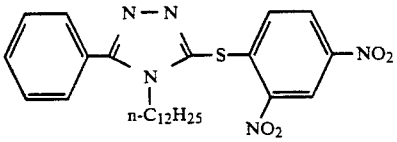 | $2\times10^{-2}$ mol/mol Ag |
| 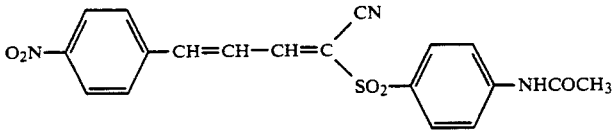 | $1\times10^{-3}$ mol/mol · Ag |
| 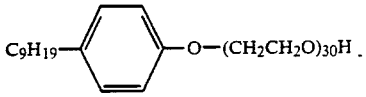 | $4\times10^{-4}$ mol/mol · Ag |
| KBr | 20 mg/m$^2$ |
| Poly(sodium styrenesulfonate) | 40 mg/m$^2$ |
| 2,6-Dichloro-6-hydroxy-1,3,5-triazine, sodium salt | 30 mg/m$^2$ |

This coating liquid was coated in such a way as to provide a coated silver weight of 3.5 g/m$^2$.

(2) Formulation of the Protective Layer 1

| | |
|---|---|
| Gelatin | 1.5 g/m$^2$ |
| Fine particles of $SiO_2$ (average particle size 4 μm; average molecular weight about 300,000) | 50 mg/m$^2$ |

(3) Formulation of the Backing Layer

| | |
|---|---|
| Gelatin | 2.5 g/m$^2$ |
| 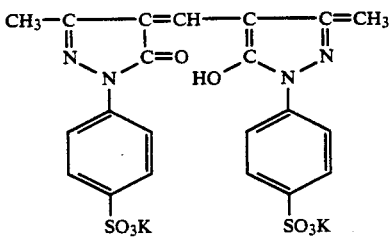 | 30 mg/m$^2$ |

-continued

| | |
|---|---|
| 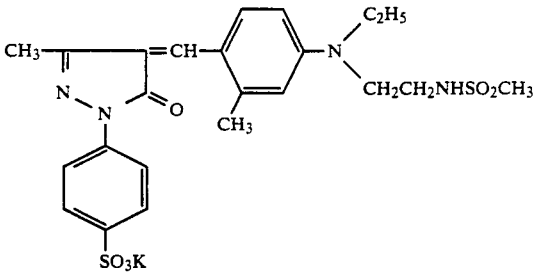 | 140 mg/m$^2$ |
| 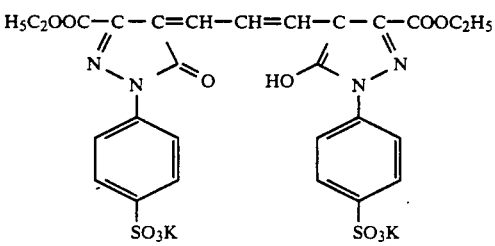 | 40 mg/m$^2$ |
| 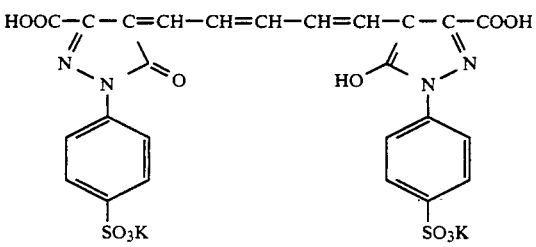 | 80 mg/m$^2$ |
| 1,3-Divinylsulfonyl-2-propanol | 150 mg/m$^2$ |
| Ethyl acrylate latex (average particle size 0.1 μm; average molecular weight about 300,000) | 900 mg/m$^2$ |
| Dihexyl-α-sulfosuccinate, sodium salt | 35 mg/m$^2$ |
| Sodium dodecylbenzenesulfonate | 35 mg/m$^2$ |

(4) Formulation of the Protective layer 2

| (4) Formulation of the Protective layer 2 | |
|---|---|
| Gelatin | 0.8 g/m$^2$ |
| Fine poly(methyl methacrylate) particles (average particle size 3 μm) | 20 mg/m$^2$ |
| Dihexyl-α-sulfosuccinate, sodium salt | 10 mg/m$^2$ |
| Sodium dodecylbenzenesulfonate | 10 mg/m$^2$ |
| Sodium acetate | 40 mg/m$^2$ |

These samples were cut to 25 cm×30 cm and packed into moisture-proof bags under the conditions shown in Table 1. Product 8 of the invention disclosed in Example 1 of JP-A-61-189936 (corresponding to U.S. Pat. No. 4,701,359) was used for the moisture-proof bags.

The samples, sealed in moisture-proof bags, were left for 2 weeks at 25° C. and the dimensional stability on development processing was then measured using the method described below.

(5) Evaluation of Dimensional Stability in Development Processing

Two holes 8 mm in diameter were cut exactly 200 mm apart in the sample. The distance between the two holes was measured after leaving the samples to stand in a 25° C. room of 30% RH for 2 hours, and recorded as X mm. The samples were then developed, fixed, washed and dried using an automatic processor and the distance between the holes was recorded after 5 minutes as Y mm. The fractional change (FC) in dimension resulting from processing was evaluated by means of the value derived from the following expression:

$$FC(\%) = \frac{Y - X}{200} \times 100$$

It is known that no difficulties will arise in practice if the fractional change in dimension is ±0.01%.

Development processing was carried out in an FG-660 automatic processor (made by the Fuji Photographic Film Co.) using GRD-1 and GRF-1 (made by the same company) as developer and fixer, at 38° C. for 20 seconds. The drying temperature was 45° C. The results obtained are shown in Table 1.

Further, the absolute humidity of the samples in moisture-proof bags was measured. For the measurement, the relative humidity at 25° C. was measured and then the absolute humidity was determined by using the air line drawing.

For the measurement of the relative humidity, a temperature and relative humidity meter MODEL HN-$U_2$ HUMI-TEMP RECORDER (made by Chino Corporation) which uses a sensor HN-L20 (made by Chino Corporation) was used. The relative humidity was converted into the absolute humidity by using the air line drawing.

TABLE 1

| Sample Number | Drying Conditions: Moisture Content (%) | Drying Time (Seconds) | A/B | Rel. Humidity Below 300% Moisture Content | Heat Treatment Conditions: Temperature | Absolute Humidity | Time | Results of Dimension Evaluation |
|---|---|---|---|---|---|---|---|---|
| 101 (Invention) | 2000 | 80 | 25 | 30° C./40% RH | 40° C. | 0.8% | 8 hours | 0.008% |
| 102 (Invention) | 2000 | 100 | 20 | 30° C./40% RH | 40° C. | 0.8% | 8 hours | 0.011% |
| 103 (Comp. Ex.) | 2000 | 120 | 16.7 | 30° C./40% RH | 40° C. | 0.8% | 8 hours | 0.020% |
| 104 (Invention) | 2000 | 80 | 25 | 30° C./50% RH | 40° C. | 0.8% | 8 hours | 0.012% |
| 105 (Comp. Ex.) | 2000 | 80 | 25 | 30° C./60% RH | 40° C. | 0.8% | 8 hours | 0.025% |
| 106 (Comp. Ex.) | 2000 | 120 | 16.7 | 30° C./60% RH | 40° C. | 0.8% | 8 hours | 0.026% |
| 107 (Invention) | 1800 | 80 | 22.5 | 30° C./40% RH | 40° C. | 0.8% | 8 hours | 0.009% |
| 108 (Invention) | 1800 | 100 | 18 | 30° C./40% RH | 40° C. | 0.8% | 8 hours | 0.012% |
| 109 (Comp. Ex.) | 1800 | 120 | 15 | 30° C./40% RH | 40° C. | 0.8% | 8 hours | 0.023% |
| 110 (Comp. Ex.) | 2000 | 80 | 25 | 30° C./40% RH | 25° C. | 0.8% | 8 hours | 0.024% |
| 111 (Invention) | 2000 | 80 | 25 | 30° C./40% RH | 30° C. | 0.8% | 8 hours | 0.010% |
| 112 (Invention) | 2000 | 80 | 25 | 30° C./40% RH | 35° C. | 0.8% | 8 hours | 0.008% |
| 113 (Invention) | 2000 | 80 | 25 | 30° C./40% RH | 45° C. | 0.8% | 8 hours | 0.007% |
| 114 (Invention) | 2000 | 80 | 25 | 30° C./40% RH | 50° C. | 0.8% | 8 hours | 0.006% |
| 115 (Invention) | 2000 | 80 | 25 | 30° C./40% RH | 55° C. | 0.8% | 8 hours | 0.006% |
| 116 (Comp. Ex.) | 2000 | 120 | 16.7 | 30° C./60% RH | 25° C. | 0.8% | 8 hours | 0.027% |

EXAMPLE 2

The parameters in Example 2 were the same as Example 1 except that the formulations indicated below were used for the silver halide emulsion layer, the protective layer 1, the backing layer and the protective layer 2.

(1) Formulation of the Silver Halide Emulsion Layer

Emulsion A was prepared according to the following procedure using liquids I, II and II as indicated below.

Liquid I: Water 300 ml, gelatin 9 grams.

Liquid II: $AgNO_3$ 100 grams, water 400 ml

Liquid III: NaCl 37 grams, $(NH_4)_3RhCl_6$ 0.66 mg, water 400 ml

Liquids II and III were added simultaneously at a constant rate to liquid I which was being maintained at 40° C. The soluble salts were removed after which gelatin was added, and 6-methyl-4-hydroxy-1,3,3a,7-tetra-azaindene and 4-hydroxy-5,6-trimethylene-1,3,3a-7-tetra-azaindene were added as stabilizers. The average grain size of the mono-dispersed emulsion was 0.15 μm and the gelatin content per kilogram of emulsion was 60 grams.

The compounds indicated below were added to this emulsion:

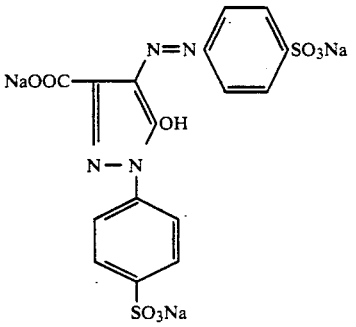

5 mg/m²

| | |
|---|---|
| Poly(sodium styrenesulfonate) | 10 mg/m² |
| 1,2-Bis(vinylsulfonylacetamido)ethane | 100 mg/m² |
| Ethyl acrylate latex (average particle size 0.1 μm; average molecular weight about 300,000) | 500 mg/m² |

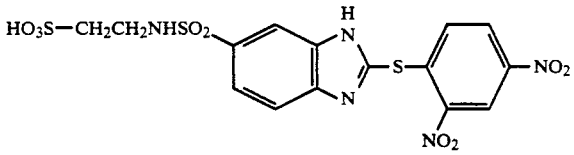

0.3 mg/m²

The coating liquid so obtained was coated in such a way as to provide a coated silver weight of 3 g/m².

(2) Formulation of the Protective Layer 1

| | |
|---|---|
| Gelatin | 1.5 g/m² |
| Fine particles of poly(methyl methacrylate) (average particle size 3 μm) | 50 mg/m² |

-continued

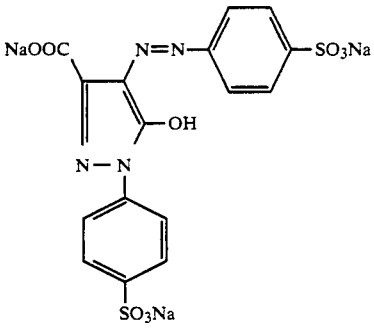

5 mg/m²

-continued

| | |
|---|---|
| Lipoic acid | 8 mg/m² |

(3) Formulation of the Backing Layer

| | |
|---|---|
| Gelatin | 2 g/m² |

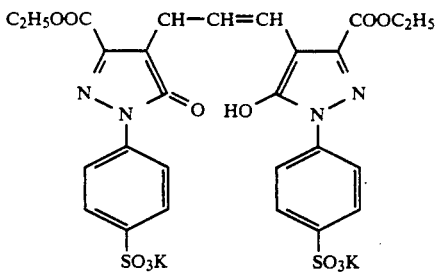

30 mg/m²

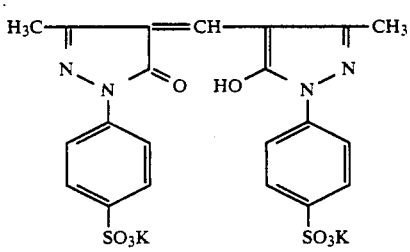

180 mg/m²

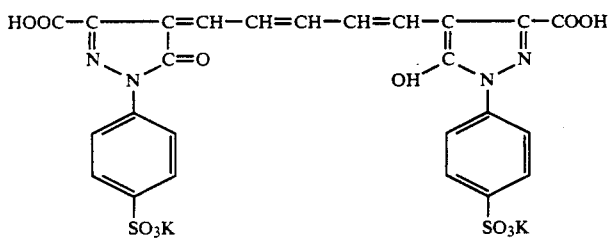

50 mg/m²

| | |
|---|---|
| Dihexyl-α-sulfosuccinate, sodium salt | 20 mg/m² |
| Sodium dodecylbenzenesulfonate | 30 mg/m² |
| Poly(sodium styrenesulfonate) | 30 mg/m² |
| 1,3-Divinylsulfonyl-2-propanol | 100 mg/m² |
| Ethyl acrylate latex (average particle size 0.1 μm, average molecular weight about 300,000) | 200 mg/m² |

(4) Formulation of the Protective Layer 2

| (4) Formulation of the Protective layer 2 | |
|---|---|
| Gelatin | 1 g/m² |
| Fine poly(methyl methacrylate) particles (average particle size 3 μm) | 40 mg/m² |
| Dihexyl-α-sulfosuccinate, sodium salt | 10 mg/m² |
| Sodium dodecylbenzenesulfonate | 30 mg/m² |
| Poly(sodium styrenesulfonate) | 25 mg/m² |
| Sodium acetate | 30 mg/m² |

| | |
|---|---|
| Sodium dodecylbenzenesulfonate | 25 mg/m² |
| Dihexyl-α-sulfosuccinate, sodium salt | 10 mg/m² |
| N-Perfluorooctanesulfonyl-N-propylglycine, potassium salt | 2 mg/m² |
| Poly(sodium styrenesulfonate) | 3 mg/m² |
| Ethyl acrylate latex (average particle size 0.1 μm; average molecular weight about 300,000) | 200 mg/m² |
| Colloidal silica | 350 mg/m² |

(5) Evaluation of Dimensional Stability in Development Processing

The coating, wrapping and development procedures and the method used for measuring dimensional changes were the same as in Example 1.

TABLE 2

| Sample Number | Drying Conditions: Moisture Content (%) | Drying Time (Seconds) | A/B | Rel. Humidity Below 300% Moisture Content | Heat Treatment Conditions: Temperature | Absolute Humidity | Time | Results of Dimension Evaluation |
|---|---|---|---|---|---|---|---|---|
| 201 (Invention) | 2000 | 80 | 25 | 30° C./40% RH | 40° C. | 0.8% | 8 hours | 0.007% |
| 202 (Invention) | 2000 | 100 | 20 | 30° C./40% RH | 40° C. | 0.8% | 8 hours | 0.009% |
| 203 (Comp. Ex.) | 2000 | 120 | 16.7 | 30° C./40% RH | 40° C. | 0.8% | 8 hours | 0.020% |
| 204 (Invention) | 2000 | 80 | 25 | 30° C./50% RH | 40° C. | 0.8% | 8 hours | 0.010% |
| 205 (Comp. Ex.) | 2000 | 80 | 25 | 30° C./60% RH | 40° C. | 0.8% | 8 hours | 0.024% |
| 206 (Comp. Ex.) | 2000 | 120 | 16.7 | 30° C./60% RH | 40° C. | 0.8% | 8 hours | 0.025% |
| 207 (Invention) | 1800 | 80 | 22.5 | 30° C./40% RH | 40° C. | 0.8% | 8 hours | 0.008% |
| 208 (Invention) | 1800 | 100 | 18 | 30° C./40% RH | 40° C. | 0.8% | 8 hours | 0.012% |
| 209 (Comp. Ex.) | 1800 | 120 | 15 | 30° C./40% RH | 40° C. | 0.8% | 8 hours | 0.023% |
| 210 (Comp. Ex.) | 2000 | 80 | 25 | 30° C./40% RH | 25° C. | 0.8% | 8 hours | 0.024% |
| 211 (Invention) | 2000 | 80 | 25 | 30° C./40% RH | 30° C. | 0.8% | 8 hours | 0.011% |
| 212 (Invention) | 2000 | 80 | 25 | 30° C./40% RH | 35° C. | 0.8% | 8 hours | 0.009% |
| 213 (Invention) | 2000 | 80 | 25 | 30° C./40% RH | 45° C. | 0.8% | 8 hours | 0.006% |
| 214 (Invention) | 2000 | 80 | 25 | 30° C./40% RH | 50° C. | 0.8% | 8 hours | 0.005% |
| 215 (Invention) | 2000 | 80 | 25 | 30° C./40% RH | 55° C. | 0.8% | 8 hours | 0.005% |
| 216 (Comp. Ex.) | 2000 | 120 | 16.7 | 30° C./60% RH | 25° C. | 0.8% | 8 hours | 0.026% |

EXAMPLE 3

The silver halide emulsion layers 1 and 2, and the protective layers 1 and 2, indicated below were coated sequentially from the support side of the support on which the second subbing layer composition 1 of Example 1 in JP-A-60-26944 (corresponding to U.S. Pat. No. 4,542,093), and dried under the conditions shown in Table 3. Next, the backing layer and the protective layer 3 were coated onto the surface of the undercoated support for which the conditions of Sample III of Example 1 in JP-A-58-62647 had been used and dried under the conditions shown in Table 3. These samples were compared in the same way as in Example 1 and the results obtained are shown in Table 3. It is clear from Table 3 that the samples of the present invention gave the best results.

(1) Formulation of the Silver Halide Emulsion Layer 1

Liquid I: Water 300 ml, gelatin 9 grams.

Liquid II: $AgNO_3$ 100 grams, water 400 ml

Liquid IIIA: NaCl 37 grams, $(NH_4)_3RhCl_6$ 1.1 mg, water 400 ml

Liquids II and IIIA were added simultaneously at a constant rate to liquid I which was being maintained at 40° C. The soluble salts were removed after which gelatin was added, and 6-methyl-4-hydroxy-1,3,3a,7-tetra-azaindene was added as a stabilizer. The average grain size of the mono-dispersed emulsion was 0.20 μm and the gelatin content per kilogram of recovered emulsion was 60 grams.

The compounds indicated below were added to this emulsion:

(Compound 1) $5 \times 10^{-3}$ mol/mol · Ag

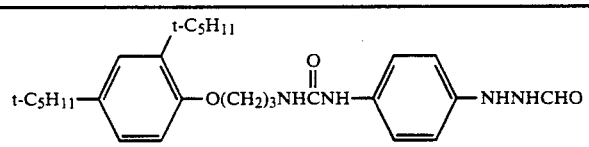

(Compound 2) 120 mg/m²

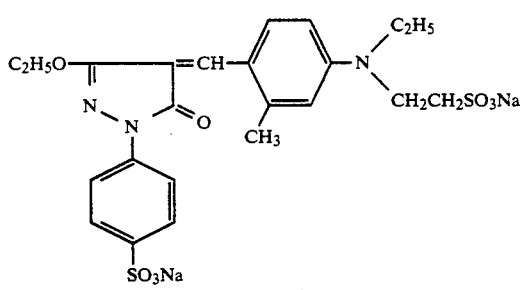

(Compound 3) 100 mg/m²

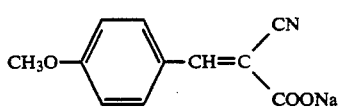

(Compound 4) 100 mg/m²

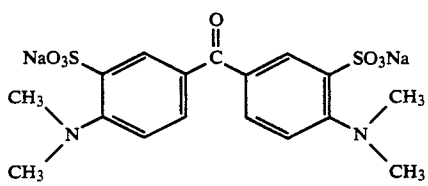

-continued

| | |
|---|---|
| (Compound 5) 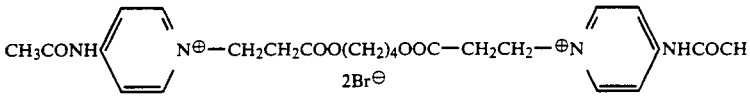 | 9 mg/m$^2$ |
| Poly(sodium styrenesulfonate) | 30 mg/m$^2$ |
| N-Oleoyl-N-methyltaurine, sodium salt | 50 mg/m$^2$ |
| 1,2-Bis(vinylsulfonylacetamido)ethane | 70 mg/m$^2$ |
| 1-Phenyl-5-mercaptotetrazole | 3 mg/m$^2$ |
| Ethyl acrylate latex (average particle size 0.1 μm, average molecular weight about 300,000) | 40 mg/m$^2$ |

The coating liquid so obtained was coated in such a way that the coated silver weight was 2 g/m$^2$.

(2) Formulation of the Silver Halide Emulsion Layer 2

Liquid I: Water 300 ml, gelatin 9 grams.

Liquid II: $AgNO_3$ 100 grams, water 400 ml

Liquid IIIB: NaCl 37 grams, $(NH_4)_3RhCl_6$ 2.2 mg, water 400 ml

Emulsion B was prepared using the same methods as used for emulsion A except that liquid IIIB was used in place of liquid IIIA. This emulsion was a mono-dispersed emulsion of average grain size 0.20 μm.

The compounds indicated below were added to the emulsion B so obtained:

| | |
|---|---|
| (Compound 1) | $5 \times 10^{-3}$ mol/mol.Ag |
| (Compound 2) | 120 mg/m$^2$ |
| (Compound 3) | 100 mg/m$^2$ |
| (Compound 4) | 100 mg/m$^2$ |
| (Compound 5) | 9 mg/m$^2$ |
| Poly(sodium styrenesulfonate) | 50 mg/m$^2$ |
| N-Oleoyl-N-methyltaurine, sodium salt | 40 mg/m$^2$ |
| 1,2-Bis(vinylsulfonylacetamido)ethane | 85 mg/m$^2$ |
| 1-Phenyl-5-mercaptotetrazole | 3 mg/m$^2$ |
| Ethyl acrylate latex (average particle size 0.1 μm, average molecular weight about 300,000) | 40 mg/m$^2$ |

The coating liquid so obtained was coated in such a way that the coated silver weight was 2 g/m$^2$.

(3) Formulation of the Protective Layer 1

| | |
|---|---|
| Gelatin | 1.0 g/m$^2$ |
| Lipoic acid | 5 mg/m$^2$ |

-continued

| | |
|---|---|
| Sodium dodecylbenzenesulfonate | 5 mg/m$^2$ |
| Compound 3 | 20 mg/m$^2$ |
| Poly(degree of polymerization 5)oxyethylene nonylphenyl ether, sulfate ester, sodium salt | 5 mg/m$^2$ |
| Poly(sodium styrenesulfonate) | 10 mg/m$^2$ |
| 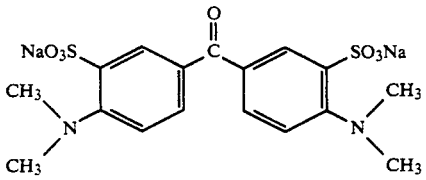 | 20 mg/m$^2$ |
| Ethyl acrylate latex (average particle size 0.1 μm, average molecular weight about 300,000) | 200 mg/m$^2$ |

(4) Formulation of the Protective Layer 2

| (4) Formulation of the Protective Layer 2 | |
|---|---|
| Gelatin | 1.0 g/m$^2$ |
| Fine particles of poly(methyl methacrylate) (average particle size 3 μm) | 60 mg/m$^2$ |
| Sodium dodecylbenzenesulfonate | 20 mg/m$^2$ |
| N-Perfluorooctanesulfonyl-N-propylglycine, potassium salt | 3 mg/m$^2$ |
| Poly(degree of polymerization 5)oxyethylene nonylphenyl ether, sulfate ester, sodium salt | 15 mg/m$^2$ |
| Poly(sodium styrenesulfonate) | 2 mg/m$^2$ |

(5) Formulation of the Backing Layer

| | |
|---|---|
| Gelatin | 2.5 g/m$^2$ |
| 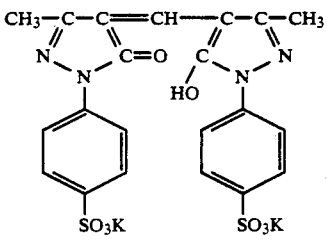 | 300 mg/m$^2$ |

-continued

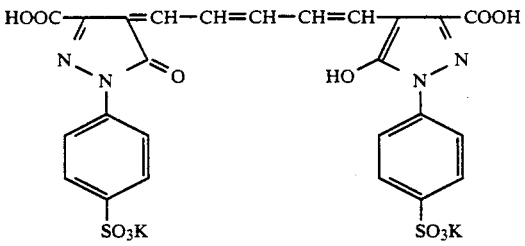

50 mg/m²

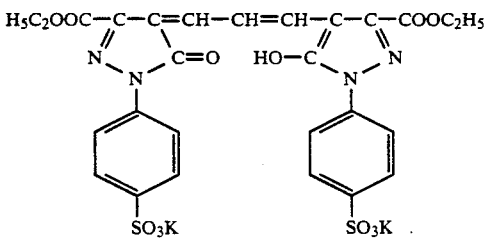

50 mg/m²

| | |
|---|---|
| Sodium dodecylbenzenesulfonate | 50 mg/m² |
| Dihexyl-α-sulfosuccinate, sodium salt | 20 mg/m² |
| Poly(sodium styrenesulfonate) | 40 mg/m² |
| 1,3-Divinylsulfonyl-2-propanol | 150 mg/m² |
| Ethyl acrylate latex (average particle size 0.1 μm, average molecular weight about 300,000) | 500 mg/m² |

(6) Formulation of the Protective layer 3 (Protective Layer for the Backing Layer

| | |
|---|---|
| Gelatin | 1 g/m² |
| Fine poly(methyl methacrylate) particles (average particle size 3 μm) | 40 mg/m² |
| Sodium dodecylbenzenesulfonate | 15 mg/m² |
| Dihexyl-α-sulfosuccinate, sodium salt | 10 mg/m² |
| Poly(sodium styrenesulfonate) | 20 mg/m² |
| Sodium acetate | 40 mg/m² |

(7)

The coating, and wrapping procedures and the method used for measuring dimensional changes were the same as in Example 1.

EXAMPLE 4

Example 4 was conducted in the same way as Example 1 except that the supports indicated below were used. The results obtained are shown in Table 4.

Four rod electrodes 40 cm in length and of a semi-circular cross section diameter of 3 cm were fixed on an insulator board with 10 cm spacing. This electrode plate was fixed in an vacuum tank and a biaxially extended poly(ethylene terephthalate) (PET) film 30 cm in width and 100 μm thick was passed at a speed of 20 m/minute on a rod opposing the electrode surface at a distance of 15 cm from the electrode plane. A heated roller 50 cm in diameter fitted with a temperature controller set at 120° C. was located so that three quarters of the circumference of this heated roller contacted the film immediately before it passed over the electrodes. A glow discharge was established by applying a voltage of 2000 V to the above mentioned electrodes while maintaining a pressure of 0.1 Torr within the tank. The electrode

TABLE 3

| | Drying Conditions | | | | Heat Treatment Conditions | | | Results of |
|---|---|---|---|---|---|---|---|---|
| Sample Number | Moisture Content (%) | Drying Time (Seconds) | A/B | Rel. Humidity Below 300% Moisture Content | Temperature | Absolute Humidity | Time | Dimension Evaluation |
| 301 (Invention) | 2000 | 80 | 25 | 30° C./40% RH | 40° C. | 0.8% | 8 hours | 0.010% |
| 302 (Invention) | 2000 | 100 | 20 | 30° C./40% RH | 40° C. | 0.8% | 8 hours | 0.013% |
| 303 (Comp. Ex.) | 2000 | 120 | 16.7 | 30° C./40% RH | 40° C. | 0.8% | 8 hours | 0.023% |
| 304 (Invention) | 2000 | 80 | 25 | 30° C./50% RH | 40° C. | 0.8% | 8 hours | 0.014% |
| 305 (Comp. Ex.) | 2000 | 80 | 25 | 30° C./60% RH | 40° C. | 0.8% | 8 hours | 0.027% |
| 306 (Comp. Ex.) | 2000 | 120 | 16.7 | 30° C./60% RH | 40° C. | 0.8% | 8 hours | 0.028% |
| 307 (Invention) | 1800 | 80 | 22.5 | 30° C./40% RH | 40° C. | 0.8% | 8 hours | 0.010% |
| 308 (Invention) | 1800 | 100 | 18 | 30° C./40% RH | 40° C. | 0.8% | 8 hours | 0.014% |
| 309 (Comp. Ex.) | 1800 | 120 | 15 | 30° C./40% RH | 40° C. | 0.8% | 8 hours | 0.025% |
| 310 (Comp. Ex.) | 2000 | 80 | 25 | 30° C./40% RH | 25° C. | 0.8% | 8 hours | 0.028% |
| 311 (Invention) | 2000 | 80 | 25 | 30° C./40% RH | 30° C. | 0.8% | 8 hours | 0.012% |
| 312 (Invention) | 2000 | 80 | 25 | 30° C./40% RH | 35° C. | 0.8% | 8 hours | 0.011% |
| 313 (Invention) | 2000 | 80 | 25 | 30° C./40% RH | 45° C. | 0.8% | 8 hours | 0.009% |
| 314 (Invention) | 2000 | 80 | 25 | 30° C./40% RH | 50° C. | 0.8% | 8 hours | 0.008% |
| 315 (Invention) | 2000 | 80 | 25 | 30° C./40% RH | 55° C. | 0.8% | 8 hours | 0.008% |
| 116 (Comp. Ex.) | 2000 | 120 | 16.7 | 30° C./60% RH | 25° C. | 0.8% | 8 hours | 0.030% |

current was 0.5 A at this time. The PET support was treated at a rate of 0.125 KVA.minute/$m^2$. An aqueous dispersion of a vinylidene chloride/methyl methacrylate/acrylic acid=90:5:5 wt % copolymer was applied to both sides of the glow discharge treated PET support treated in this way as a first subbing layer. This first subbing layer was rod coated to provide a thickness of 0.5 μm and dried at a temperature of 120° C.

A coating liquid described below was rod coated at a rate of 20 ml/$m^2$ over this first subbing layer as a second subbing layer, and dried at 160° C.

(1) Formulation of the Second Subbing Layer

| | |
|---|---|
| Gelatin | 1.0 part by weight |
| Epichlorhydrin reaction product of a polyamide comprised of diethylenetriamine and adipic acid | 0.07 part by weight |
| Saponin | 0.01 part by weight |
| Water | to 100 parts by weight |

(1) Formulation of the Silver Halide Emulsion Layer

As a stabilizer, 4-Hydroxy-6-methyl-1,3,3a,7-tetraazaindene was added to a silver chlorobromide emulsion (Br 1 mol %, average grain size 0.2 μm) which contained $1\times10^{-5}$ mol of rhodium per mol of silver and which had not been chemically sensitized. The tetrazolium salt indicated below was added to this emulsion at the rate of $5\times10^{-3}$ mol per mol of silver.

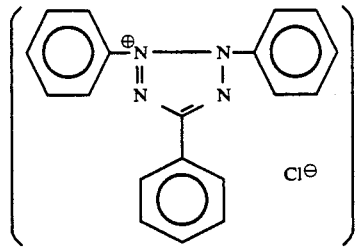

TABLE 4

| Sample Number | Drying Conditions: Moisture Content (%) | Drying Time (Seconds) | A/B | Rel. Humidity Below 300% Moisture Content | Heat Treatment Conditions: Temperature | Absolute Humidity | Time | Results of Dimension Evaluation |
|---|---|---|---|---|---|---|---|---|
| 401 (Invention) | 2000 | 80 | 25 | 30° C./40% RH | 40° C. | 0.8% | 8 hours | 0.003% |
| 402 (Invention) | 2000 | 100 | 20 | 30° C./40% RH | 40° C. | 0.8% | 8 hours | 0.005% |
| 403 (Comp. Ex.) | 2000 | 120 | 16.7 | 30° C./40% RH | 40° C. | 0.8% | 8 hours | 0.015% |
| 404 (Invention) | 2000 | 80 | 25 | 30° C./50% RH | 40° C. | 0.8% | 8 hours | 0.006% |
| 405 (Comp. Ex.) | 2000 | 80 | 25 | 30° C./60% RH | 40° C. | 0.8% | 8 hours | 0.018% |
| 406 (Comp. Ex.) | 2000 | 120 | 16.7 | 30° C./60% RH | 40° C. | 0.8% | 8 hours | 0.019% |
| 407 (Invention) | 1800 | 80 | 22.5 | 30° C./40% RH | 40° C. | 0.8% | 8 hours | 0.004% |
| 408 (Invention) | 1800 | 100 | 18 | 30° C./40% RH | 40° C. | 0.8% | 8 hours | 0.008% |
| 409 (Comp. Ex.) | 1800 | 120 | 15 | 30° C./40% RH | 40° C. | 0.8% | 8 hours | 0.016% |
| 410 (Comp. Ex.) | 2000 | 80 | 25 | 30° C./40% RH | 25° C. | 0.8% | 8 hours | 0.017% |
| 411 (Invention) | 2000 | 80 | 25 | 30° C./40% RH | 30° C. | 0.8% | 8 hours | 0.005% |
| 412 (Invention) | 2000 | 80 | 25 | 30° C./40% RH | 35° C. | 0.8% | 8 hours | 0.004% |
| 413 (Invention) | 2000 | 80 | 25 | 30° C./40% RH | 45° C. | 0.8% | 8 hours | 0.002% |
| 414 (Invention) | 2000 | 80 | 25 | 30° C./40% RH | 50° C. | 0.8% | 8 hours | 0.001% |
| 415 (Invention) | 2000 | 80 | 25 | 30° C./40% RH | 55° C. | 0.8% | 8 hours | 0.001% |
| 416 (Comp. Ex.) | 2000 | 120 | 16.7 | 30° C./60% RH | 25° C. | 0.8% | 8 hours | 0.020% |

EXAMPLE 5

Example 5 was conducted in the same way as Example 1 except that the silver halide emulsion layer coating liquid described below was used. The results are shown in Table 5.

As a polymer matrix, polymer 3 having average molecular weight of about 300,000 was added to this emulsion in sufficient quantity to provide 1.4 g/$m^2$.

While the invention has been described in detail and with reference to specific embodiments thereof, it will be apparent to one skilled in the art that various changes and modifications can be made therein without departing from the spirit and scope thereof.

TABLE 5

| Sample Number | Drying Conditions: Moisture Content (%) | Drying Time (Seconds) | A/B | Rel. Humidity Below 300% Moisture Content | Heat Treatment Conditions: Temperature | Absolute Humidity | Time | Results of Dimension Evaluation |
|---|---|---|---|---|---|---|---|---|
| 501 (Invention) | 2000 | 80 | 25 | 30° C./40% RH | 40° C. | 0.8% | 8 hours | 0.007% |
| 502 (Invention) | 2000 | 100 | 20 | 30° C./40% RH | 40° C. | 0.8% | 8 hours | 0.009% |
| 503 (Comp. Ex.) | 2000 | 120 | 16.7 | 30° C./40% RH | 40° C. | 0.8% | 8 hours | 0.020% |
| 504 (Invention) | 2000 | 80 | 25 | 30° C./50% RH | 40° C. | 0.8% | 8 hours | 0.010% |
| 505 (Comp. Ex.) | 2000 | 80 | 25 | 30° C./60% RH | 40° C. | 0.8% | 8 hours | 0.024% |
| 506 (Comp. Ex.) | 2000 | 120 | 16.7 | 30° C./60% RH | 40° C. | 0.8% | 8 hours | 0.026% |
| 507 (Invention) | 1800 | 80 | 22.5 | 30° C./40% RH | 40° C. | 0.8% | 8 hours | 0.009% |
| 508 (Invention) | 1800 | 100 | 18 | 30° C./40% RH | 40° C. | 0.8% | 8 hours | 0.012% |
| 509 (Comp. Ex.) | 1800 | 120 | 15 | 30° C./40% RH | 40° C. | 0.8% | 8 hours | 0.023% |
| 510 (Comp. Ex.) | 2000 | 80 | 25 | 30° C./40% RH | 25° C. | 0.8% | 8 hours | 0.024% |
| 511 (Invention) | 2000 | 80 | 25 | 30° C./40% RH | 30° C. | 0.8% | 8 hours | 0.011% |
| 512 (Invention) | 2000 | 80 | 25 | 30° C./40% RH | 35° C. | 0.8% | 8 hours | 0.009% |
| 513 (Invention) | 2000 | 80 | 25 | 30° C./40% RH | 45° C. | 0.8% | 8 hours | 0.007% |
| 514 (Invention) | 2000 | 80 | 25 | 30° C./40% RH | 50° C. | 0.8% | 8 hours | 0.006% |
| 515 (Invention) | 2000 | 80 | 25 | 30° C./40% RH | 55° C. | 0.8% | 8 hours | 0.006% |
| 516 (Comp. Ex.) | 2000 | 120 | 16.7 | 30° C./60% RH | 25° C. | 0.8% | 8 hours | 0.028% |

What is claimed is:

1. A method for producing a silver halide photographic material which comprises the steps of:

(a) coating hydrophilic colloid coating liquid on a polyester support;

(b) forming a hydrophilic colloid layer by drying said hydrophilic coating liquid, when A is not more than 300, in an atmosphere having a relative humidity of not more than 50% and such that the ratio A/B is at least 18 wherein

A is determined by the following formula:

$$A=(M/S)\times 100$$

wherein M represents the moisture content by weight of said hydrophilic colloid layer on said support and S represents the solid weight of said hydrophilic colloid layer on said support, and B is the drying time until A is not more than 8 expressed in seconds; and (c) heat treating said coated support from step (b) at a temperature of at least 30° C. in an atmosphere having an absolute humidity of not more than 1%.

2. The method for producing a silver halide photographic material as in claim 1, wherein the ratio A/B is from 20 to 40.

3. The method for producing a silver halide photographic material as in claim 1, wherein said step (b) of forming a hydrophilic colloid layer is done in an atmosphere having a relative humidity of from 35 to 50%.

4. The method for producing a silver halide photographic material as in claim 1, wherein said step (c) of heat treating said coated support is done at a temperature of at least 35° C. but not more than 50° C.

5. The method for producing a silver halide photographic material as in claim 1, wherein said step (c) of heat treating said coated support is done when said absolute humidity is not more than 0.8%.

6. The method for producing a silver halide photographic material as in claim 1, wherein said polyester support is a polyester in which aromatic dibasic acids and glycols form principal structural components.

7. The method for producing a silver halide photographic material as in claim 6, wherein said polyester support is poly(ethylene terephthalate).

8. The method for producing a silver halide photographic material as in claim 1, wherein the thickness of said polyester support is from about 12 μm to about 500 μm.

9. A method for producing a silver halide photographic material which comprises the steps of:

(a) coating a subbing layer on one side of a polyester support;

(b) coating hydrophilic colloid coating liquid containing binder on the opposite side of said polyester support from said subbing layer;

(c) forming a hydrophilic colloid layer by drying said hydrophilic coating liquid, when A is not more than 300, in an atmosphere having a relative humidity of not more than 50% and such that the ratio A/B is at least 18 wherein

A is determined by the following formula:

$$A=(M/S)\times 100$$

wherein M represents the moisture content by weight of said hydrophilic colloid layer on said support and S represents the solid weight of said hydrophilic colloid layer on said support, and B is the drying time until A is not more than 8 expressed in seconds; and (d) heat treating said coated support from step (c) at a temperature of at least 30° C. in an atmosphere having an absolute humidity of not more than 1%.

10. The method for producing a silver halide photographic material as in claim 9, wherein said polyester support is poly(ethylene terephthalate).

11. The method for producing a silver halide photographic material as in claim 9, wherein said subbing layer contains vinylidene chloride.

* * * * *